US008963444B2

(12) United States Patent
Montante et al.

(10) Patent No.: US 8,963,444 B2
(45) Date of Patent: Feb. 24, 2015

(54) CONTROLLING THE LIGHT OUTPUT OF ONE OR MORE LEDS IN RESPONSE TO THE OUTPUT OF A DIMMER

(75) Inventors: Charles J. Montante, Hawthorn Woods, IL (US); William Trzyna, Elgin, IL (US)

(73) Assignee: CCI Power Supplies LLC, Pardeeville, WI (US)

( * ) Notice: Subject to any disclaimer, the term of this patent is extended or adjusted under 35 U.S.C. 154(b) by 258 days.

(21) Appl. No.: 13/479,815

(22) Filed: May 24, 2012

(65) Prior Publication Data

US 2012/0299511 A1 Nov. 29, 2012

Related U.S. Application Data

(60) Provisional application No. 61/490,443, filed on May 26, 2011.

(51) Int. Cl.
*H05B 37/02* (2006.01)
*H05B 33/08* (2006.01)

(52) U.S. Cl.
CPC ..... *H05B 33/0815* (2013.01); *H05B 33/0851* (2013.01)
USPC ..... 315/291

(58) Field of Classification Search
CPC ..... H05B 37/02; H05B 33/08; H05B 37/00; H05B 41/24
USPC ..... 315/294, 291, 200 R, 209 R, 246, 247, 315/241 R, 312
See application file for complete search history.

(56) References Cited

U.S. PATENT DOCUMENTS

| | | | | |
|---|---|---|---|---|
| 6,448,713 | B1 * | 9/2002 | Farkas et al. | 315/291 |
| 7,178,941 | B2 | 2/2007 | Roberge et al. | |
| 7,186,003 | B2 | 3/2007 | Dowling et al. | |
| 7,255,457 | B2 | 8/2007 | Ducharme et al. | |
| 7,750,579 | B2 | 7/2010 | Aiello | |
| 8,125,159 | B2 | 2/2012 | Aiello | |
| 8,405,319 | B2 | 3/2013 | Sadwick et al. | |
| 2002/0101193 | A1 | 8/2002 | Frakas et al. | |
| 2010/0134038 | A1 | 6/2010 | Shackle et al. | |

(Continued)

FOREIGN PATENT DOCUMENTS

| | | |
|---|---|---|
| CN | 101926222 | 7/2012 |
| KR | 10-2009-0048100 | 5/2009 |

(Continued)

OTHER PUBLICATIONS

Korean Intellectual Property Office, International Search Report and Written Opinion in patent application PCT/US2012/039360 (dated Dec. 3, 2012).

(Continued)

*Primary Examiner* — Minh D A
(74) *Attorney, Agent, or Firm* — Fish & Richardson P.C.

(57) ABSTRACT

An apparatus for controlling the brightness of one or more light emitting diodes includes a sensing circuit to sense a dimming level of a dimmer. A microprocessor receives from the sensing circuit a signal indicative of the dimming level, and a drive circuit drives the one or more light emitting diodes. The microprocessor is arranged to generate a PWM waveform or current level corresponding to the dimming level and to provide the PWM waveform or current level to the drive circuit.

13 Claims, 7 Drawing Sheets

(56) References Cited

U.S. PATENT DOCUMENTS

| | | | | |
|---|---|---|---|---|
| 2011/0043133 | A1 | 2/2011 | Van Laanen et al. | |
| 2011/0101879 | A1* | 5/2011 | McNay | 315/247 |
| 2011/0115399 | A1* | 5/2011 | Sadwick et al. | 315/287 |
| 2011/0121754 | A1* | 5/2011 | Shteynberg et al. | 315/294 |
| 2011/0227940 | A1 | 9/2011 | Neal | |

FOREIGN PATENT DOCUMENTS

| | | | |
|---|---|---|---|
| KR | 10-2009-0048100 | A | 5/2009 |
| KR | 10-0912133 | | 8/2009 |
| KR | 10-0912133 | B1 | 8/2009 |
| KR | 10-2010-0107055 | | 10/2010 |
| KR | 10-2010-0107055 | A | 10/2010 |
| TW | 201106794 | | 2/2011 |

OTHER PUBLICATIONS

Korean Intellectual Property Office, International Search Report and Written Opinion in International Patent Appln. No. PCT/US2012/039360 (Dec. 3, 2012).

List of references cited in official communication from the Taiwanese Patent in Application No. 101118837 dated Aug. 27, 2014 (1 page).

State Intellectual Property Office of China(SIPO), official communication for application No. 201280036991.8, one page (Dec. 3, 2014).

* cited by examiner

CONTROLLING THE LIGHT OUTPUT OF ONE OR MORE LEDS IN RESPONSE TO THE OUTPUT OF A DIMMER

CROSS-REFERENCE TO RELATED APPLICATION(S)

This application claims the benefit of priority of U.S. Provisional Patent Application Ser. No. 61/490,443, filed on May 26, 2011, the contents of which are incorporated by reference in their entirety.

BACKGROUND

Dimmers often are used in homes, theaters and studios, as well as other locations. For example, a lighting fixture containing tungsten lamps can be connected to a dimmer switch on the wall which changes the fixture light output depending on the position of a knob or slider in the dimmer.

In general, the dimmer is connected to an alternating current (AC) line, which provides a voltage that varies with time, typically in the shape of a sine wave. The dimmer modifies the shape of the sine wave to reduce the power delivered to the lamp. Triac, silicon controlled rectifier (SCR) and Insulated Gate Bipolar Transistor (IGBT)-based dimmers accomplish this result by cutting off a portion of the sine wave. Sine wave dimmers achieve this result by reducing the amplitude of the sine wave.

Because of the greater efficiency of light emitting diodes (LEDs), there is movement toward having LED-based light sources replace tungsten lamps. For many applications, this involves using an array of LEDs to obtain the equivalent light output of a tungsten lamp. LEDs are current driven devices and require a minimum voltage for current to flow. Their light output can be changed by changing the current through the device or by rapidly turning the current on and off. The greater the percentage of time the current is on, the greater the amount of light that is produced.

LEDs, however, cannot easily be driven directly by a conventional dimmer (i.e., those designed to be used with a tungsten lamp). For example, LEDs typically require a low DC voltage drive (e.g., 1-5 volts), whereas a conventional dimmer output is a higher AC voltage (e.g., 100-250 volts). If an LED were driven by a conventional dimmer in conjunction with a voltage rectification and reduction circuit, the light output of the combination would not respond to the dimmer changes in the same way as a tungsten lamp.

SUMMARY

This disclosure describes controlling the brightness of one or more LEDs based on the output of a dimmer. In some implementations, although the dimmer may be designed, for example, to control the brightness of an incandescent lamp, the disclosed techniques allow it to be used with LEDs.

According to one aspect, an apparatus for controlling the brightness of one or more light emitting diodes includes a sensing circuit to sense a dimming level of a dimmer. A microprocessor receives from the sensing circuit a signal indicative of the dimming level, and a drive circuit drives the one or more light emitting diodes. The microprocessor is arranged to generate a PWM waveform or current level corresponding to the dimming level and to provide the PWM waveform or current level to the drive circuit.

In some implementations, the sensing circuit includes a capacitive element that charges when an output of the dimmer is non-zero. For example, the capacitive element may integrate a waveform based on the dimmer output. In some implementations, the microprocessor includes a look-up table and is arranged to look up settings for the PWM waveform or the current level based on a voltage level across the capacitive element.

In some implementations, the apparatus includes a snubber circuit to absorb energy generated by ringing of an inductive element in the dimmer. The apparatus also may include a circuit to provide a signal to the microprocessor indicative of a state of the dimmer (e.g., whether or not the dimmer is conducting). The microprocessor can be arranged to control whether the snubber circuit is on or off based on the signal indicative of the state of the dimmer. In this way, the snubber circuit can be controlled such that it is on substantially only when it is needed to absorb energy caused by ringing of the dimmer.

Some implementations include a power factor correction circuit coupled between an output of the dimmer and the drive circuit. The microprocessor receives a signal from the power factor correction circuit indicative of whether the power factor correction circuit is on or off. If the signal from the power factor correction circuit indicates that the power factor correction circuit is on, the microprocessor generates a PWM waveform having a duty cycle that is based on the signal from the sensing circuit indicative of the dimming level and provides the PWM waveform to the drive circuit. On the other hand, if the signal from the power factor correction circuit indicates that the power factor correction circuit is off, the microprocessor maintains the duty cycle of the PWM waveform as previously generated.

In some implementations, the microprocessor is arranged to generate multiple PWM waveforms based on the signal indicative of the dimming level and to provide the PWM waveforms to the drive circuit to drive respective groups of light emitting diodes. For example, a first PWM waveform may have a first duty cycle and a second PWM waveform may have a second duty cycle, wherein the ratio of the first duty cycle to the second duty cycle is in accordance with one or more input signals received by the microprocessor. For example, in some implementations, the ratio of the first duty cycle to the second duty cycle is adjustable upward or downward in fixed increments. The microprocessor can be arranged such that a pulse applied to an input pin causes the ratio of the first and second duty cycles to increase or decrease by a predetermined amount. Such features can allow the ratio of the first and second duty cycles to be user-configurable.

In some implementations, one or more of the foregoing aspects are combined in a single apparatus. Methods of controlling the brightness of one or more light emitting diodes also are described.

Other aspects, features and advantages will be apparent from the following detailed description, the accompanying drawings and the claims.

DETAILED DESCRIPTION

Figure 1:
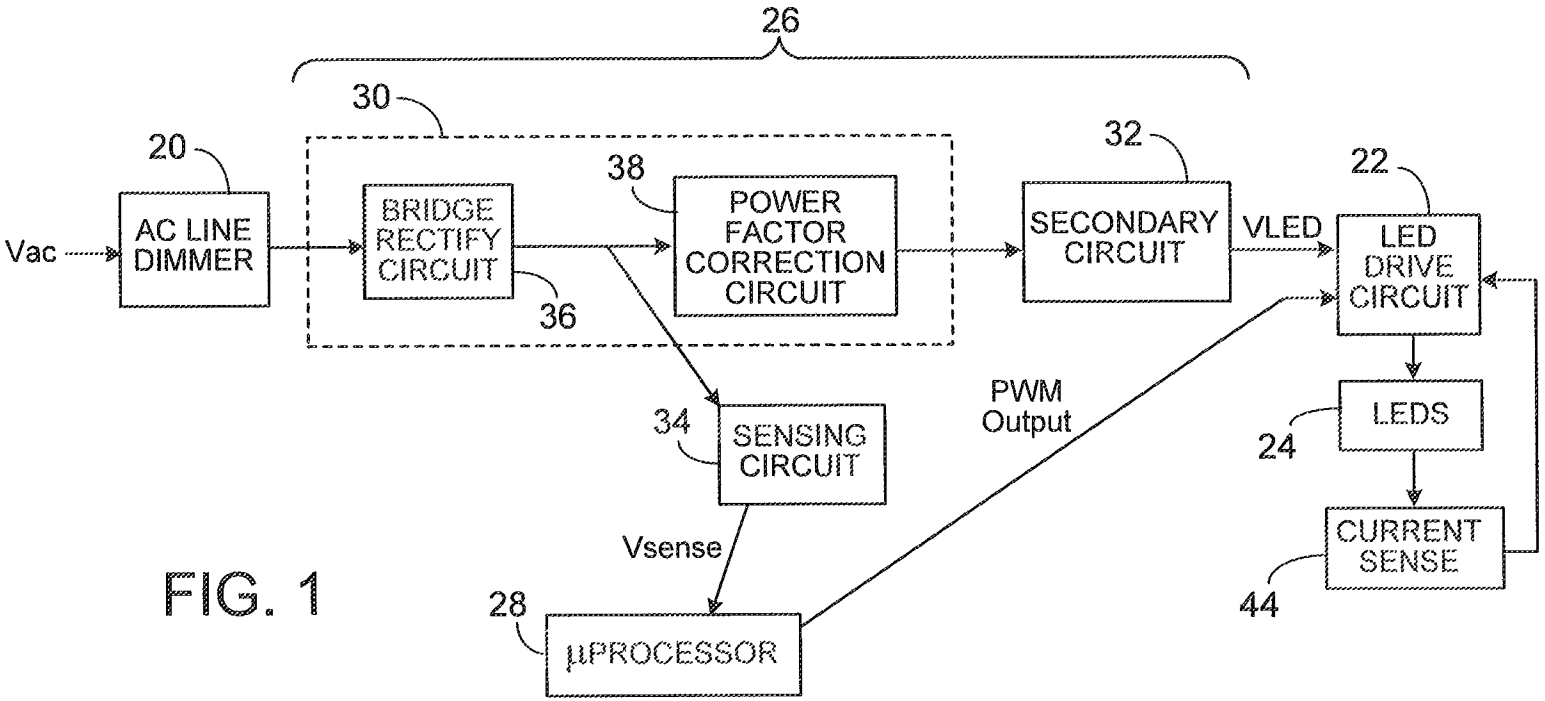
FIG. 1 illustrates an example of a micro-processor based system for controlling the light output of one or more LEDs.

As illustrated in FIG. 1, a microprocessor-based system senses the dimming level of an AC line dimmer 20 and translates the sensed level into a pulse width modulated (PWM) or other output signal that is used by a drive circuit 22 to vary the level or duty cycle of current supplied to one or more LEDs 24 (e.g., an array or string of LEDs) or other constant current circuits. Pulse width modulation (PWM) involves supplying a substantially constant current to the LEDs for particular periods of time. The shorter the on-time, or pulse-width, the less brightness an observer will perceive in the resulting light.

As used in the present disclosure, the term "LED" includes light emitting diodes of all types (e.g., semiconductor and organic light emitting diodes). Furthermore, the term "LED" may refer to a single light emitting device having multiple semiconductor dies that are individually controlled. The term "LED" does not restrict the package type of an LED; for example, the term "LED" can refer to a packaged LED, non-packaged LED, surface mount LED, chip-on-board LED, and an LED of other configurations.

The microprocessor-based techniques described here use circuitry connected to the output of the dimmer 20. Such circuitry, which includes a converter circuit 26 and the drive circuit 22, converts the dimmer output to relatively steady DC outputs to power the microprocessor 28 and the LEDs 24. In some implementations, there is one output signal to drive the LEDs, but in other implementations, there may be two or more output signals, each of which drives a different group of the LEDs 24. Some implementations include circuitry 44 to sense the current flowing through the LEDs 24 and to provide feedback to the LED drive circuit 22.

The portion of the converter circuitry 26 connected to the dimmer is called the primary side circuit 30. In the illustrated example, the primary side circuit 30 includes a bridge rectify circuit 36 and a power factor correction circuit 38. The output from the dimmer 20 is provided to the bridge rectify circuit 36, whose output, in turn, is provided to the power factor correction circuit 38. The primary side of the converter 26 also includes a primary winding of a transformer. The portion of the converter circuitry 26 connected to the DC output is called the secondary side circuit 32 and can include, for example, active electronic devices and one or more secondary windings of the transformer.

The operating voltage of the LEDs 24 may vary, for example, from 1-5 volts DC, depending on the type, color and manufacturer of the LED. In various implementations, the LEDs 24 may be connected in parallel or in series, which can change the required driving voltage to higher levels (e.g., 12 volts, 24 volts, or 48 volts), depending on the particular LED arrangement. The secondary circuit 32 provides the required driving voltage (VLED) and current at a fixed predetermined level, which is provided to the LED drive circuit 22.

Figure 2:
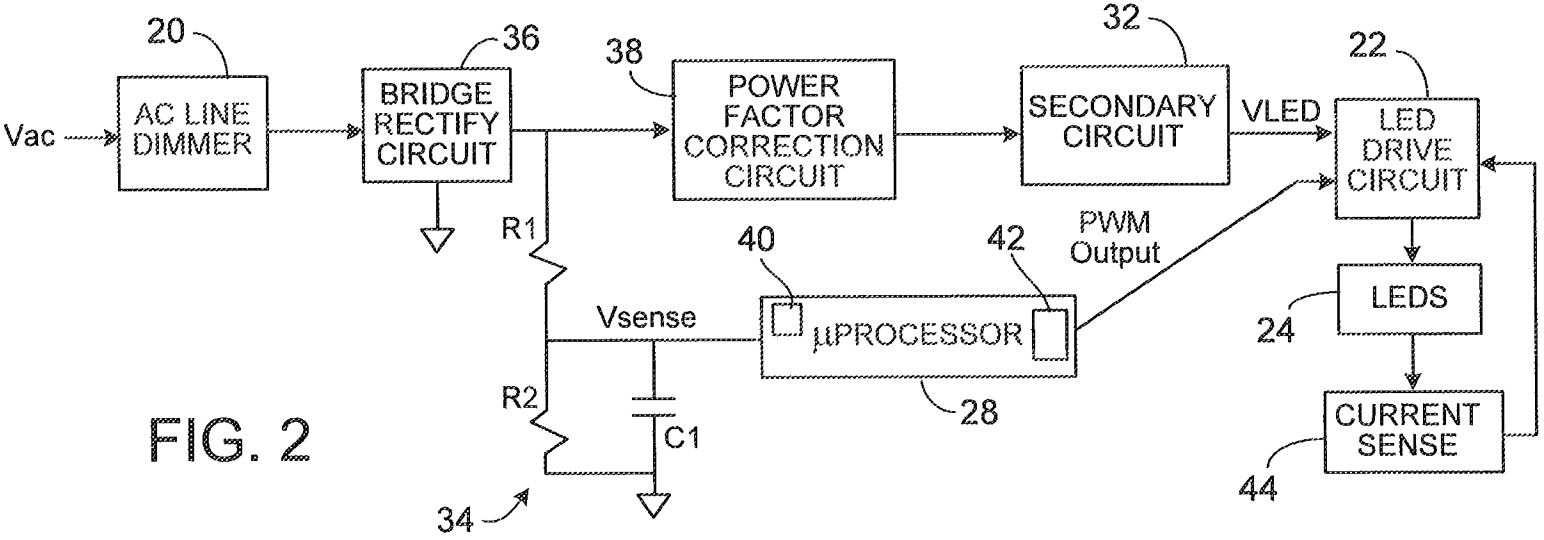
FIG. 2 illustrates further details of the system of FIG. 1, including a sense circuit, according to some implementations.

In various implementations, the dimming level of the dimmer 20 can be sensed on either the primary or secondary side of the converter circuitry 26. In the example of FIG. 1, an output from sensing circuitry 34 on the primary side circuit 30 is provided to the microprocessor 28. For example, an output taken from a node between the bridge rectify circuit 36 and the power factor correction circuit 38 can be provided to the sensing circuit 34. The dimmer level can be sensed, for example, by measuring the time between zero crossing points or by the voltage built up across a capacitor. As illustrated in the example of FIG. 2, the sensing circuit 34 is composed of a resistor divider network that includes a first resistor R1 and a second resistor R2 and that reduced the magnitude of the voltage seen by the microprocessor 28. The second resistor R2 is in parallel with a capacitor C1, which charges when the dimmer output is non-zero and discharges when the dimmer output is zero. The voltage ("VSENSE") across the capacitor C1 is proportional to the amount of time the input is non-zero. In some implementations, the value of capacitor is about 1 μF, although the value may be different for other implementations. The sensed voltage ("VSENSE") is provided to the microprocessor 28. One advantage of using a capacitor to sense the dimmer level is that it can be used to sense the value from a sine wave dimmer as well as a Triac, SCR or IGBT dimmer. In the case of a sine wave dimmer, the voltage across the capacitor varies with the peak of the dimmer sine wave.

Thus, according to some implementations, the dimmer 20 setting is sensed by using a capacitor C1 to integrate the input waveform. The capacitor voltage ("VSENSE") can be measured, for example, with an analog-to-digital converter (ADC) 40 in the microprocessor 28. The measured value can be used to look up the PWM settings or current level corresponding to the capacitor voltage level in a look-up table 42. Alternatively, the microprocessor 28 can execute an algorithm to calculate the PWM settings or current level. Based on these settings, a PWM waveform or current level is generated and provided to the drive circuit 22 to drive the LEDs 24. Thus, the sensed voltage across the capacitor C1 is converted to a corresponding PWM signal having the appropriate duty cycle.

In some implementations, the microprocessor 28 includes firmware to measure the zero crossing time or the capacitor voltage, and to perform the mathematical transformation of the measured data so as to compensate for one or more of the nonlinearity of the dimming level sensing circuit, the nonlinearity of the light output of the lamp being mimicked with respect to the dimming input, and the non-linearity of the human eye's perception of brightness. As noted above, this transformation can be accomplished, for example, by an algorithm coded in the firmware or by storing the information in one or more lookup tables 42 included in the firmware or by a combination of both methods. The use of look-up table(s) can allow a less powerful and, thus, less expensive, microprocessor 28 to be used.

An advantage of the foregoing approaches is that the microprocessor 28 can be programmed to tailor the PWM signal output so that the light emanating from the LED(s) mimics the light output perceived from a tungsten lamp. The PWM signal output also can be tailored to match the response of the human eye. The human eye integrates the light it receives over a period of time and, even though the current through the LED may generate the same light level regardless of pulse duration, the eye can perceive short pulses as "dimmer" than longer pulses.

As explained above, the PWM waveform or current level is generated and provided to the drive circuit 22. The drive circuit 22 chops the VLED signal received from the secondary circuit 32 at a frequency rate higher, for example, than 120 Hz (e.g., near 3 kHz) determined by system operation and costs. The drive circuit 22 uses the PWM output from the microprocessor 28 to adjust the duty cycle of the chopped frequency signal and to control the power provided to the LEDs 24 and, thus, the light output. For example, at a 0% duty cycle, the LEDs 24 would be off. On the other hand, when the chopped frequency is at a 100% duty cycle, the LEDs 24 would be on at their full capacity.

Figure 3:
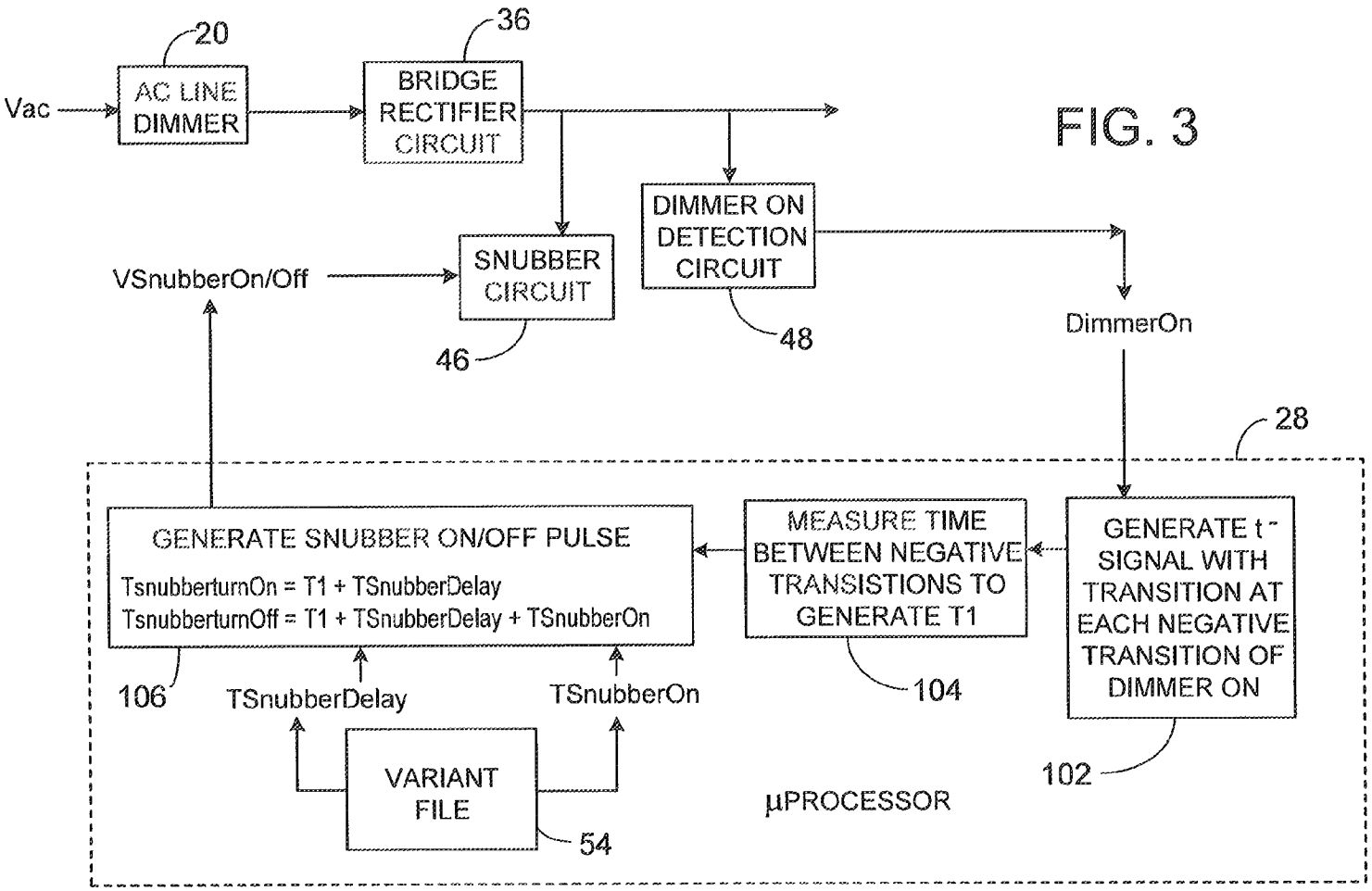
FIG. 3 illustrates further details of the system of FIG. 1 according to some implementations.

Some dimmers, such as triac-based dimmer circuits, include an inductor which rings when the triac turns on. In some situations, the ring voltage can become less than 0 volts, which can cause the triac to turn off. This may occur, for example, when the triac is at or near its maximum power transfer setting. To prevent the triac from turning off, the excursion of the ringing can be reduced so that it does not go below zero. As shown in FIG. 3, the reduction in ringing can be accomplished by providing a snubber circuit 46 to absorb energy from the ringing.

In principle, absorption of energy by the snubber circuit 46 is only needed during the ringing. However, without further provisions, the snubber circuit 46 will remain turned on constantly, which can result in a significant amount of wasted power (e.g., as much as 10 W out of 300 W in some implementations). This situation can result in a significant reduction in the power supply efficiency and reduces the amount of power available for transfer to the LEDs 24.

To address the foregoing issue, the power supply can include a circuit 48 that generates a signal ("DimmerOn") based on the output from the bridge rectify circuit 36 to indicate the time dimmer 20 is conducting. The circuit 48 provides the DimmerOn signal to the microprocessor 28, which is configured to turn on the snubber circuit 46 only when it is needed (see FIG. 3), thereby reducing the amount of wasted power and allowing the use of lower wattage parts in the snubber, which can be smaller and less expensive.

Figure 4:
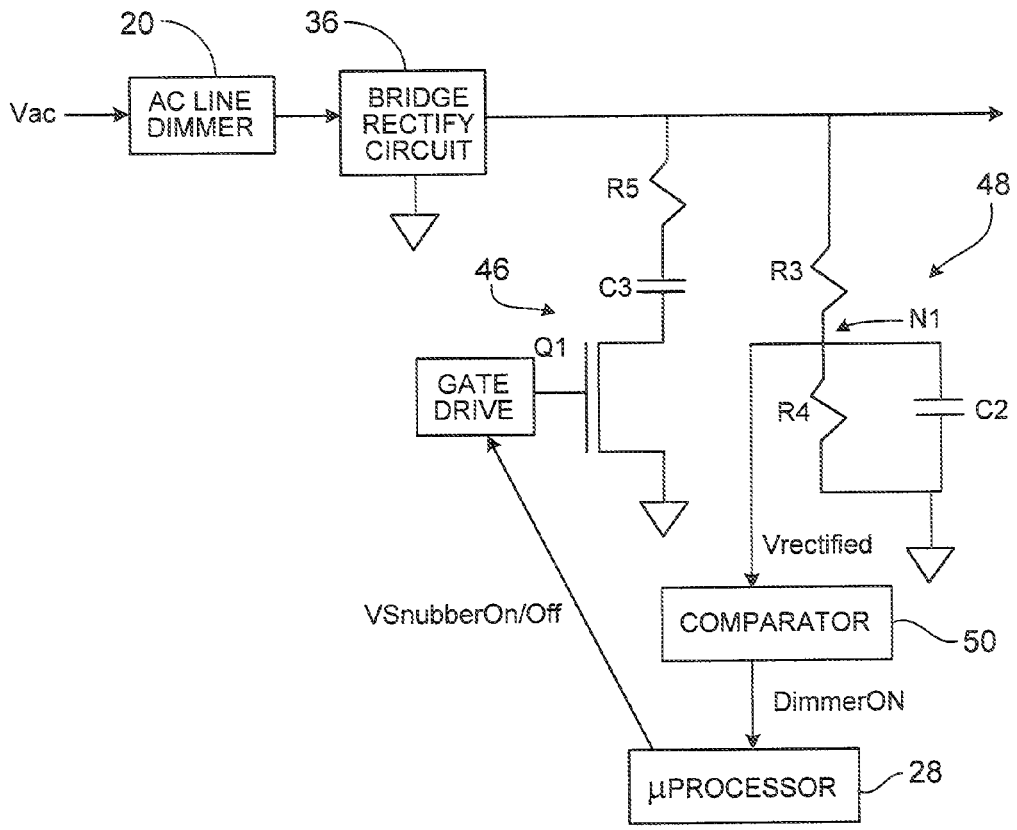
FIG. 4 illustrates further details of the system of FIG. 1, including a snubber circuit, according to some implementations.
Figure 5:
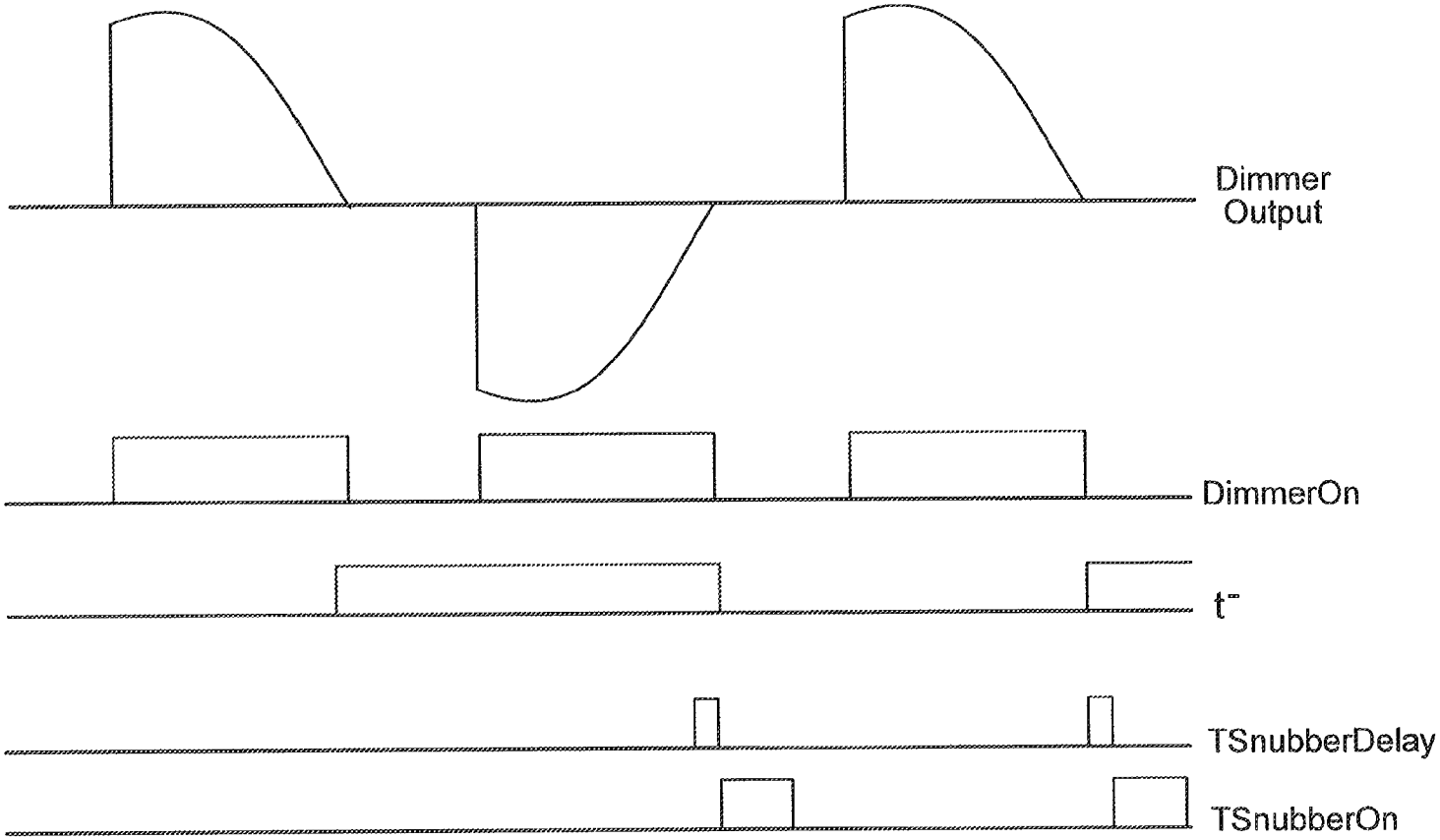
FIG. 5 illustrates examples of waveforms to explain operation of the system according to some implementations.

Details of the circuit 48 according to some implementations are illustrated in FIG. 4. In the illustrated example, the circuit 48 includes a resistor divider network composed of a first resistor R3 and a second resistor R4. A capacitor C2 is in parallel with the second resistor R4. In some implementations, the capacitor has a value of about 1 nF. A voltage signal ("Vrectified"), which appears at node N1 connecting the two resistors R3 and R4, corresponds to the output of the bridge rectifier circuit 36, with a reduced amplitude. The Vrectified signal is provided as an input to a comparator 50, which shapes the waveform into a square wave signal ("DimmerOn") that is positive when the dimmer 20 is conducting (see FIG. 5). Thus, the DimmerOn signal can be generated by the comparator 50 based on a rectified signal of the dimmer 20. The DimmerOn signal is provided as an input to the microprocessor 28.

FIG. 4 also illustrates details of the snubber circuit 46 according to some implementations. In the illustrated example, the microprocessor 28 is configured so as to cause the snubber circuit 46 to turn on before the start of each half cycle of the square wave and to extend to a specified amount of time after the dimmer 20 turns on. In particular, the microprocessor 28 generates an output signal ("VSnubberOn/Off"), which is applied to the gate of a transistor Q1. The transistor Q1 can be implemented, for example, as a field effect transistor (FET), whose source is connected to ground and whose drain is connected in series with a resistor R5 and capacitor C3. When turned on, the snubber circuit 46 adds a load to the output of the bridge rectifier circuit 36, which causes the inductor in the dimmer 20 to discharge more quickly so as to prevent the dimmer from turning off.

To generate the VSnubberOn/Off signal, the microprocessor 28 generates a square wave signal ("T-" in FIG. 5) that has a transition at each negative transition of the DimmerOn signal (block 102 in FIG. 3). The microprocessor 28 measures the time between negative going transitions of the t-signal, with this time defined as T1 (block 104). This measurement can be made, for example, on start-up or at reset. Preferably, the snubber circuit 46 should be turned on and kept on while the measurement is made. As explained below, the microprocessor 28 then can determine the start time and end time for the snubber circuit 46 to be turned on based on the value of T1 (block 106).

In the illustrated implementation, the microprocessor 28 has a variant file 45 that stores values TSnubberDelay and TSnubberOn, for example, in microseconds. The microprocessor 28 calculates a TsnubberturnOn value and a TsnubberturnOff value, where $$T\text{snubberturnOn}=T1+T\text{SnubberDelay, and}$$

$$T\text{snubberturnOff}=T1+T\text{SnubberDelay}+T\text{SnubberOn.}$$

Following a negative transition of the DimmerOn signal, the snubber circuit 46 is turned on at time TsnubberturnOn and is turned off at time TsnubberturnOff. This process can be repeated until the power supply is turned off or reset. In some implementations, an inverted form of the VSnubberOn/Off signal is provided to drive the gate of the transistor Q1. The microprocessor 28 thus generates a pulse signal to control turning the snubber circuit 46 on and off such that the snubber circuit 46 is on substantially only when it is needed to absorb energy caused by ringing of the dimmer 20.

As described above, the power supply circuit includes a power factor correction circuit 38 that takes a DC signal from the bridge rectify circuit 36 and steps it up to a higher DC voltage. In some implementations, the power factor correction circuit 38 also smooths the current drawn from the bridge rectifier circuit 36. Depending on the load, the power factor correction circuit 38 may be on or off. When the power factor correction circuit 38 is off, the output signal (Vsense) from the sensing circuit 34 may change and may no longer represent the brightness level of the dimmer. To address such situations, a signal ("PFC_ON") is provided from the power factor correction circuit 38 as an input to the microprocessor 28 and indicates to the microprocessor whether the power factor correction circuit 38 is on or off. If the PFC_ON signal indicates that the power factor correction circuit 38 is on, then the microprocessor 28 determines the duty cycle of the PWM signal based on the signal Vsense from the sensing circuit 34. On the other hand, if the PFC_ON signal indicates that the power factor correction circuit 38 is off, then the microprocessor 28 ignores the current value of the signal Vsense and uses the previous value of the duty cycle for the PWM signal. Thus, when the PFC_ON signal indicates that the power factor correction circuit 38 is off, the microprocessor 28 maintains a PWM signal with a substantially constant duty cycle until the PFC_ON signal indicates that the power factor correction circuit 38 is on. This feature allows the microprocessor 28 to compensate to an error in the voltage on the sense capacitor C1 that may occur when the power factor correction circuit 38 is off.

When the power factor correction circuit 38 turns back on, it adds a load to the sense capacitor C1 and causes it to come down to a voltage that represents the brightness. However, it takes time for the voltage to decay to the appropriate level. On the other hand, the microprocessor 28 may take a reading very soon after the power factor correction circuit 38 comes back on, resulting in a reading having a value that is too high. To address this issue, a delay value ("PFC_ON_READ_DELAY") can be stored in the variant file 54 (see FIG. 3). This value is used by the microprocessor 28 so as not to read the ADC 40 (see FIG. 2) for the specified delay period after the power factor correction circuit 38 comes back on. In some implementations, another value ("PFC_OFF_DEBOUNCE_TIME") also is stored in the variant file 54 and indicates the time (e.g., in milliseconds) that the PFC_ON signal has to be detected as off before the delay takes effect.

Figure 6:
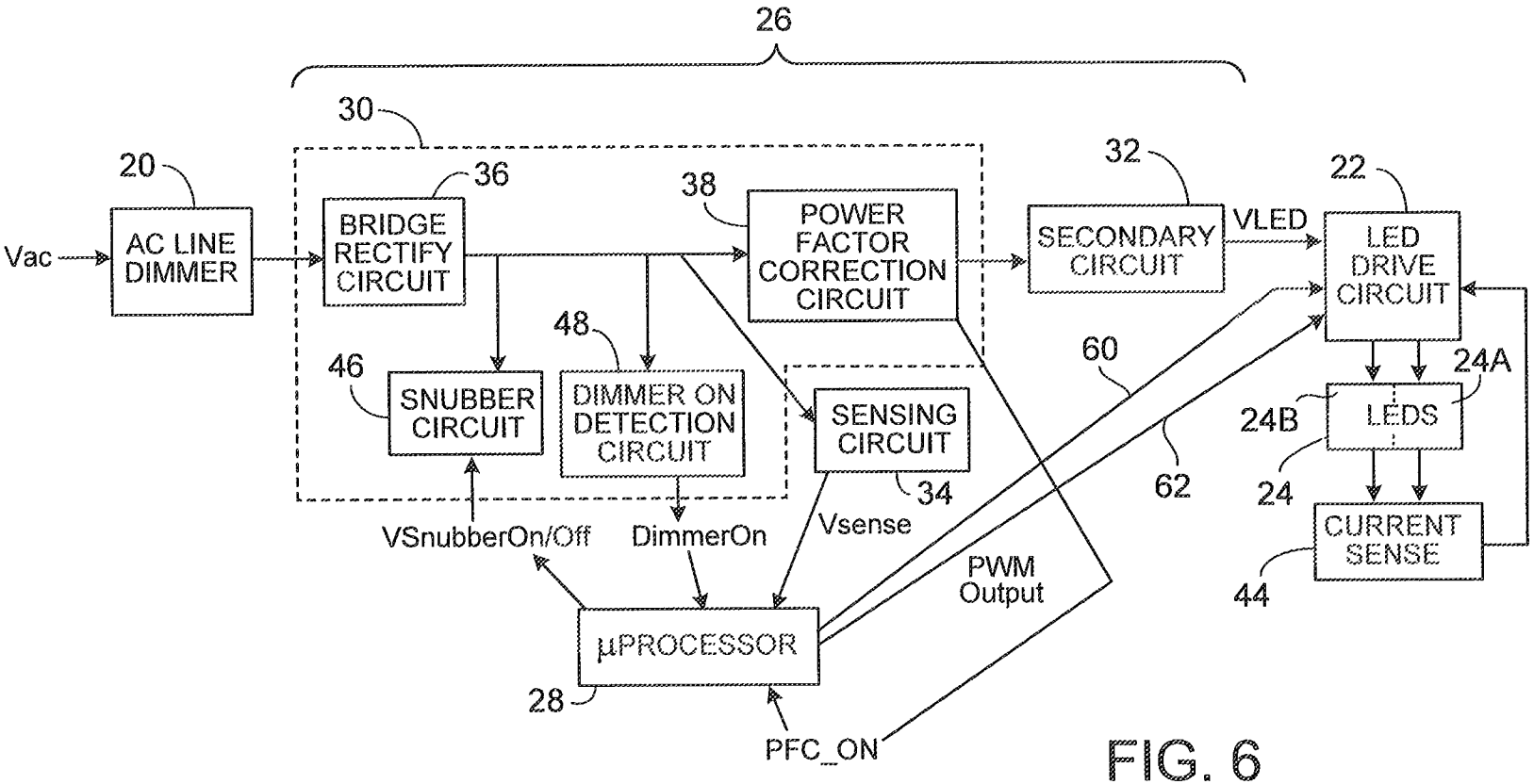
FIG. 6 illustrates an implementation in which the system generates multiple PWM signals to control groups of LEDs.

In some implementations, the microprocessor 28 generates one PWM signal that is provided to the LED drive circuit 22. However, in some implementations, it may be desirable for the microprocessor 28 to generate two or more PWM signals having different duty cycles from one another or output signals having different current levels from one another. For example, as illustrated in FIG. 6, a first PWM signal 60 having a first duty cycle can be used to control one group of LEDs (e.g., white LEDs emitting light in a first wavelength range) 24A, whereas a second PWM signal 62 having a second duty cycle can be used to control a second group of LEDs (e.g., white LEDs emitting light in a second wavelength range) 24B.

In a particular implementation, the microprocessor 28 generates two PWM signals having a frequency of approximately 2400 Hz. One PWM signal controls string(s) of "cold" white LEDs, and the second PWM signal controls string(s) of "warm" white LEDs, where "cold" and "warm" refer to different color ranges. The microprocessor 28 maintains the PWM duty cycle ratio of the two PWM signals over substantially the entire dimming range. For example, if the PWM duty cycle ratio at full brightness is 100% for the cold white LEDs to 50% for the warm white LEDs, it will be 50% for the cold white LEDs to 25% for the warm white LEDs if the dimmer input sets the brightness to 50%. The microprocessor 28 can be pre-programmed, for example, with a default ratio of 100% for the cold white LEDs to 50% for the warm white LEDs, although other pre-programmed default ratios can be used as well.

Thus, some implementations provide the ability to have different duty cycles or current levels for different LED strings that vary proportionately to the dimming level of the dimmer, while maintaining a user-adjustable ratio between the duty cycles or current levels. This feature can allow mixing colors of LED strings of different colors to obtain a composite color and modify its brightness with the dimmer.

In the illustrated example, two opto-isolated control connectors are provided to change the ratio of the PWM signal duty cycle of the cold white LEDs to the PWM signal duty cycle of the warm white LEDs. Each pulse ("IncrementDutyCycle") provided to a first one of the control connectors increases the duty cycle of the PWM signal for the warm white LEDs by about 1%. On the other hand, each pulse ("DecrementDutyCycle") provided to the second one of the control connectors decreases the duty cycle of the PWM signal for the warm white LEDs by about 1%. For example, each 5-volt pulse having a one-msec duration can be applied to the appropriate pin of the microprocessor 28 to increase or decrease the brightness of the warm white LEDs by about 1%. The brightness of the cold white LEDs would continue to be determined based on the Vsense signal from the sensing circuit 34. Thus, the ratio of the duty cycles for a pair of PWM signals is user-configurable. In some implementations, the changed setting for the warm white LEDs is stored by the microprocessor 28 such that if power is removed from the device and subsequently reconnected, the device will power the warm white LED's at the same setting as before the power was disconnected.

Figure 7:
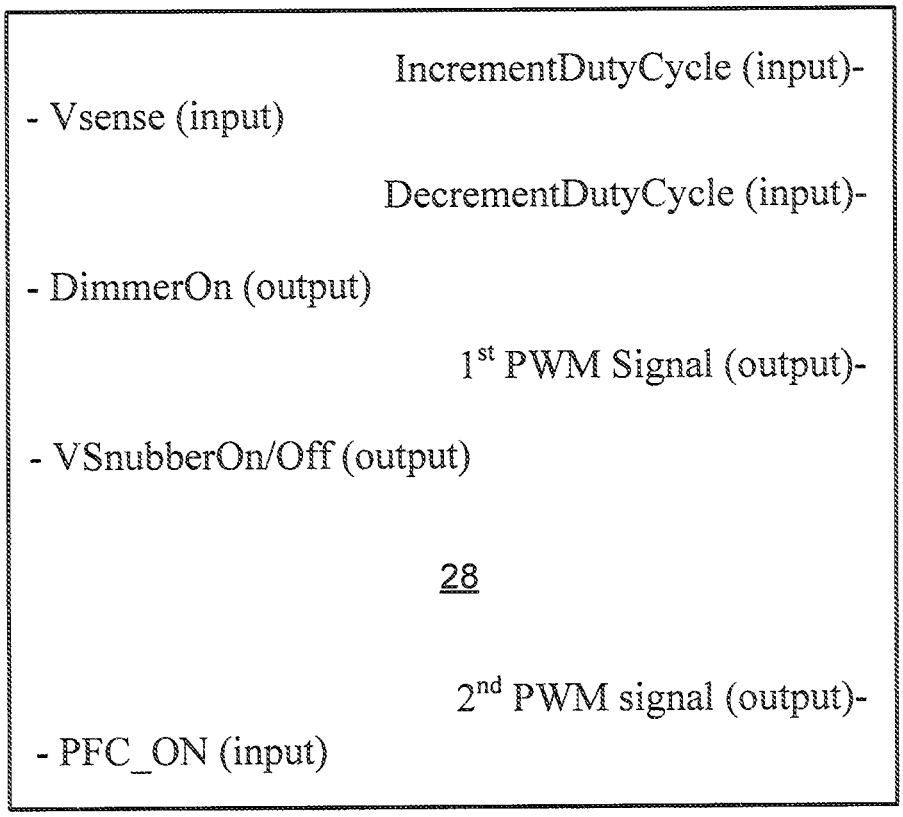
FIG. 7 illustrates various input/output pins for the microprocessor according to some implementations.

As illustrated in FIG. 7, depending on the particular features of the implementation, an integrated circuit chip for the microprocessor 28 may include pins for various input and output signals. For example, various pins can be provided for the following input signals: Vsense, DimmerOn, PFC_ON, IncrementDutyCycle, and DecrementDutyCycle. Likewise, various pins can be provided for the following output signals: one or more PWM signals, and VSnubberOn/Off. Some implementations may include all of the foregoing input/output pins, whereas other implementations may include fewer than all the pins. The microprocessor chip also may include additional pins for other input/output signals, as well as various power (e.g., Vcc, ground), clock and control signals.

Other implementations are within the scope of the claims.

What is claimed is:

1. An apparatus for controlling the brightness of one or more light emitting diodes, the apparatus comprising:

a sensing circuit to sense a dimming level of a dimmer, wherein the sensing circuit includes a capacitive element to integrate a waveform based on the dimmer output;

a circuit to provide a signal to the microprocessor indicative of whether the dimmer is conducting;

a drive circuit to drive the one or more light emitting diodes;

a snubber circuit to absorb energy generated by ringing of an inductive element in the dimmer;

a power factor correction circuit for coupling between an output of the dimmer and the drive circuit, a microprocessor to receive from the sensing circuit a signal indicative of the dimming level, wherein the microprocessor is arranged to generate a PWM waveform and to provide the PWM waveform to the drive circuit, wherein the microprocessor is further arranged to control whether the snubber circuit is on or off based on the signal indicative of whether the dimmer is conducting, and wherein the microprocessor is arranged to receive a signal from the power factor correction circuit indicative of whether the power factor correction circuit is on or off, wherein, if the signal from the power factor correction circuit indicates that the power factor correction circuit is on, the microprocessor generates a PWM waveform having a duty cycle in accordance with the signal from the sensing circuit indicative of the dimming level and provides the PWM waveform to the drive circuit, and wherein, if the signal from the power factor correction circuit indicates that the power factor correction circuit is off, the microprocessor generates the PWM waveform having the same duty cycle as just prior to receiving the signal indicating that the power factor correction circuit is off.

2. The apparatus of claim 1 wherein the microprocessor is arranged to generate first and second PWM waveforms based on the signal indicative of the dimming level and to provide the PWM waveforms to the drive circuit to drive respective groups of light emitting diodes, and wherein the first PWM waveform has a first duty cycle and the second PWM waveform has a second duty cycle, and wherein a ratio of the first duty cycle to the second duty cycle is in accordance with pre-established criteria.

3. An apparatus for controlling the brightness of one or more light emitting diodes, the apparatus comprising:

a sensing circuit to sense a dimming level of a dimmer based at least in part on integration of a waveform corresponding to an output voltage of the dimmer, wherein the sensing circuit includes a capacitive element that charges when the output voltage of the dimmer is non-zero;

a microprocessor to receive from the sensing circuit a signal indicative of the dimming level; and a drive circuit to drive the one or more light emitting diodes, wherein the microprocessor is arranged to generate a PWM waveform or current level corresponding to the dimming level and to provide the PWM waveform or current level to the drive circuit, and wherein the microprocessor includes a look-up table, the microprocessor arranged to look up settings for the PWM waveform or the current level based on a voltage level across the capacitive element.

4. The apparatus of claim 3 wherein the capacitive element integrates the waveform corresponding to the dimmer output.

5. The apparatus of claim 3 wherein the sensing circuit includes a resistor divider network, wherein the capacitive element is in parallel with a portion of the resistor divider network.

6. An apparatus for controlling the brightness of one or more light emitting diodes, the apparatus comprising:

a sensing circuit to sense a dimming level of a dimmer;

a microprocessor to receive from the sensing circuit a signal indicative of the dimming level; and a drive circuit to drive the one or more light emitting diodes, wherein the microprocessor is arranged to generate a PWM waveform or current level corresponding to the dimming level and to provide the PWM waveform or current level to the drive circuit, the apparatus further including:

a snubber circuit to absorb energy generated by ringing of an inductive element in the dimmer when the one or more light emitting diodes are turned on, and a circuit to provide a signal to the microprocessor indicative of a state of the dimmer, wherein the microprocessor is arranged to control whether the snubber circuit is on or off based on the signal indicative of the state of the dimmer, wherein the circuit to provide a signal indicative of the state of the dimmer is operable to rectify an output signal from the dimmer and convert the rectified signal into a square wave signal that is positive when the dimmer is on, the square wave signal being provided to the microprocessor, and wherein the microprocessor is arranged to cause the snubber circuit to turn on before the start of each half cycle of the square wave and to extend to a specified amount of time after the dimmer turns on.

7. The apparatus of claim 6 wherein the snubber circuit includes a capacitive element in series with a resistive element.

8. The apparatus of claim 7 wherein the snubber circuit includes a transistor in series with the capacitive element and resistive element, wherein the transistor has a gate that receives a signal from the microprocessor to control a state of the transistor.

9. An apparatus for controlling the brightness of one or more light emitting diodes, the apparatus comprising:

a sensing circuit to sense a dimming level of a dimmer based at least in part on integration of a waveform corresponding to an output voltage of the dimmer, wherein the sensing circuit includes a capacitive element that charges when the output voltage of the dimmer is non-zero;

a microprocessor to receive from the sensing circuit a signal indicative of the dimming level;

a drive circuit to drive the one or more light emitting diodes; and a power factor correction circuit coupled between an output of the dimmer and the drive circuit, wherein the microprocessor receives a signal from the power factor correction circuit indicative of whether the power factor correction circuit is on or off, wherein, if the signal from the power factor correction circuit indicates that the power factor correction circuit is on, the microprocessor generates a PWN waveform having a duty cycle that is based on the signal from the sensing circuit indicative of the dimming level and provides the PWM waveform to the drive circuit, the microprocessor including a look-up table and arranged to look up settings for the PWM waveform based on a voltage level across the capacitive element, and wherein, if the signal from the power factor correction circuit indicates that the power factor correction circuit is off, the microprocessor maintains the duty cycle of the PWM waveform as previously generated.

10. The apparatus of claim 9 wherein the sensing circuit includes a capacitive element that integrates a waveform based on the dimmer output.

11. An apparatus for controlling the brightness of multiple groups of light emitting diodes, the apparatus comprising:

a sensing circuit to sense a dimming level of a dimmer, wherein the sensing circuit includes a capacitive element that charges when an output of the dimmer is non-zero;

a microprocessor to receive from the sensing circuit a signal indicative of the dimming level; and a drive circuit to drive the one or more light emitting diodes, wherein the microprocessor is arranged to generate first and second PWM waveforms based on the signal indicative of the dimming level and to provide the PWM waveforms to the drive circuit to drive respective groups of light emitting diodes, wherein the first PWM waveform has a first duty cycle and the second PWM waveform has a second duty cycle, and wherein a ratio of the first duty cycle to the second duty cycle is in accordance with one or more input signals received by the microprocessor, and wherein the microprocessor is arranged such that a pulse applied to an input pin causes the ratio of the first and second duty cycles to increase or decrease by a predetermined amount, the ratio being user-configurable.

12. The apparatus of claim 11 wherein the ratio of the first duty cycle to the second duty cycle is adjustable upward or downward in fixed increments.

13. The apparatus of claim 11, wherein the first PWM waveform is provided to the drive circuit to drive a first group of light emitting diodes, and the second PWM is provided to the drive circuit to drive a second group of light emitting diodes; and wherein the first group of light emitting diodes is operable to emit light in a first wavelength range, and the second group of light emitting diodes is operable to emit light in a second wavelength range different than the first wavelength range.

* * * * *

UNITED STATES PATENT AND TRADEMARK OFFICE

CERTIFICATE OF CORRECTION

PATENT NO. : 8,963,444 B2
APPLICATION NO. : 13/479815
DATED : February 24, 2015
INVENTOR(S) : Charles J. Montante and William Trzyna It is certified that error appears in the above-identified patent and that said Letters Patent is hereby corrected as shown below:

In the Claims

Column 10

Claim 9, line 8, delete "PWN" and insert -- PWM --.

Signed and Sealed this
Twenty-third Day of June, 2015

Michelle K. Lee

Michelle K. Lee
*Director of the United States Patent and Trademark Office*